US009698498B1

(12) United States Patent
Wang et al.

(10) Patent No.: US 9,698,498 B1
(45) Date of Patent: Jul. 4, 2017

(54) CONNECTOR WITH SPRING CONTACT

(71) Applicant: Rockwell Automation Technologies, Inc., Mayfield Heights, OH (US)

(72) Inventors: Yutao Wang, Brookfield, WI (US); Steven T. Haensgen, Mukwonago, WI (US); Jeffrey A. Kilburn, Hartland, WI (US); John P. Caspers, Racine, WI (US); Darryl E. Whitley, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 15/161,894

(22) Filed: May 23, 2016

(51) Int. Cl.

| | |
|---|---|
| ***H01R 13/64*** | (2006.01) |
| ***H01R 4/24*** | (2006.01) |
| ***H01R 12/72*** | (2011.01) |
| ***H01R 13/629*** | (2006.01) |

(52) U.S. Cl.
CPC ..... *H01R 4/245* (2013.01); *H01R 12/721* (2013.01); *H01R 13/629* (2013.01)

(58) Field of Classification Search
CPC ..... H01R 13/6315; H01R 13/629; H01R 13/6272; H01R 13/6456; H01R 12/712; H01R 12/716; H01R 12/737; H01R 4/24; H01R 12/67; H01R 13/506; H01R 23/66; H01R 25/14; H01R 4/2433
See application file for complete search history.

(56) References Cited

U.S. PATENT DOCUMENTS

| | | | | |
|---|---|---|---|---|
| 4,190,952 | A * | 3/1980 | Thomas | H01R 12/675 29/749 |
| 4,252,396 | A | 2/1981 | Wilson | |
| 4,255,009 | A * | 3/1981 | Clark | H01R 4/2462 439/398 |
| 4,470,655 | A * | 9/1984 | Kalka | H01R 4/2433 439/397 |
| 4,655,528 | A * | 4/1987 | Groft | H01R 12/675 439/404 |
| 5,059,137 | A | 10/1991 | Dale et al. | |
| 6,232,557 | B1 | 5/2001 | Lounsbury et al. | |
| 6,425,770 | B1 | 7/2002 | Lostoski et al. | |
| 6,793,536 | B2 * | 9/2004 | Takeyama | H01R 11/05 439/631 |
| 8,613,625 | B2 * | 12/2013 | Costa | H01R 4/2433 439/116 |
| 8,793,096 | B2 * | 7/2014 | Lammers | B60R 16/03 340/538 |
| 9,065,260 | B2 * | 6/2015 | Billman | H02G 5/02 |

* cited by examiner

*Primary Examiner* — Xuong Chung Trans
(74) *Attorney, Agent, or Firm* — Timothy P. Boppre

(57) ABSTRACT

The disclosed embodiments relate generally to a modular connector for a multi-conductor ribbon cable provided for power and data transmission to a network of devices. The modular connector is coupled to the conductors in the ribbon cable by insulation displacement members. When the connector is attached to the ribbon cable and disconnected from a device a continuous circuit path is provided and when connected to a device configurable circuit paths are provided.

21 Claims, 11 Drawing Sheets

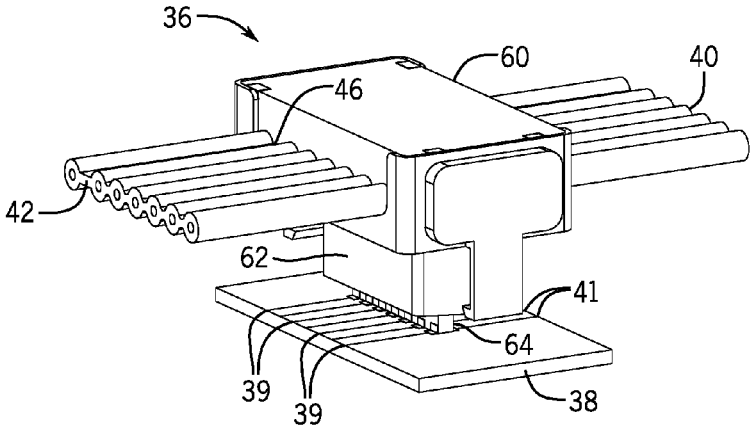
FIG. 2
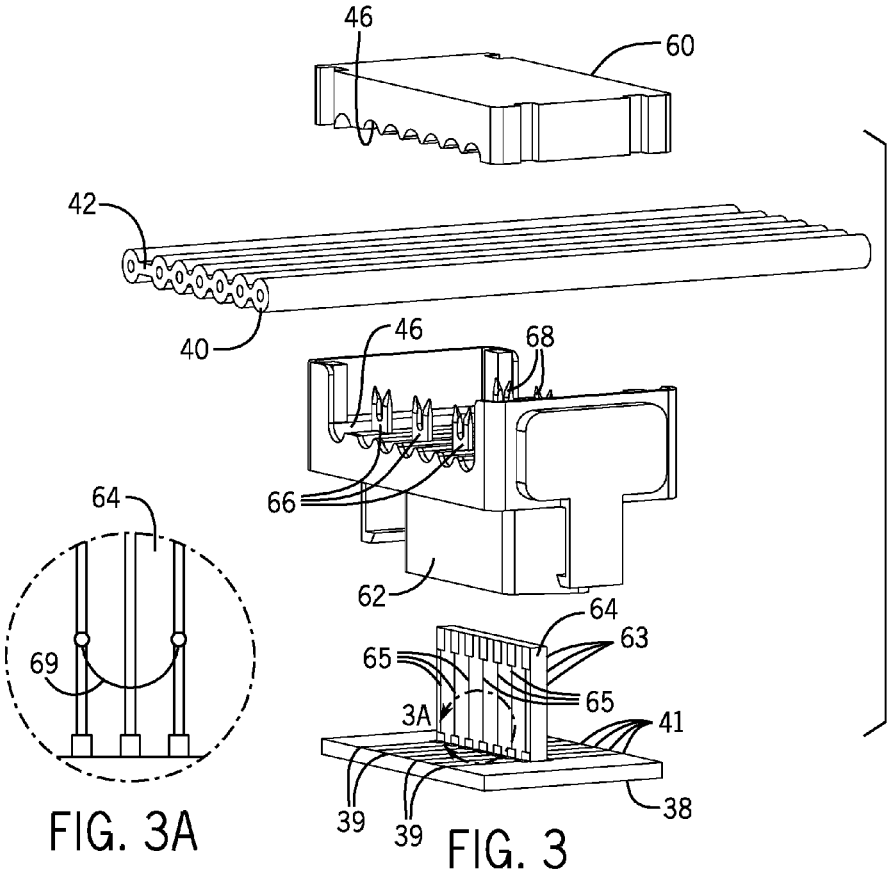
FIG. 3A
FIG. 3

CONNECTOR WITH SPRING CONTACT

BACKGROUND

The disclosed embodiments relate generally to cables and connectors used in conjunction with network transmission media of the type used in industrial control, monitoring, and similar power and data network systems. More particularly, the disclosed embodiments relate to a novel modular connector for use with such a cable and associated network. The modular connector and cable are designed for use in an industrial-type control and monitoring system in which a number of device nodes receive various forms of power and data via the conductors in the cable via the conductor and associated interface.

Such power and data network systems typically include a number of device nodes coupled to a set of common conductors for transmitting power and data. The node devices often include both sensors and actuators of various types, as well as microprocessor-based controllers or other command circuitry. Power supplies coupled to the network furnish electrical energy via the network media to power interface devices and operate actuators, sensors, and other devices. In operation, devices on the network process the transmitted parameter data and command operation of networked devices as push-button switches, motor starters, proximity sensors, flow sensors, speed sensors, actuating solenoids, electrical relays, electrical contactors, and so forth.

The transmission of both power and data on the same cable presents several challenges, some of these being; reliably establishing a connection to the network, maintaining network continuity when de-coupling devices from the network, supplying additional power to an installed network, and mitigation of noise induced on the data conductors by the power conductors. Due to the nature of an industrial network as described, devices may be located at various points on the network for a given application. This necessitates the ability to quickly and reliably place connectors on a multi-conductor cable anywhere along its length. Additionally, it is desirable to maintain the electrical continuity of both the power and data transmitted on the network when a device is removed from a network. Given the fact that various forms of electrical power are provided to devices via the network cable, power will vary by application and changes made to existing applications it is desirable to have means by which to provide additional power to the network and its devices. And finally, unlike unpowered data networks, in the case of a network transmission media conveying various forms of electrical energy and data there is the increased potential for unwanted noise or interference between conductors due to the nature of energizing and de-energizing coils, the opening and closing of contacts of devices on the network, and the general environment in which the network may be located.

There is a need, therefore, for an improved network media connector and associated cable for use in industrial control networks and the like. More particularly, there is a need for a connector and associated cable that quickly and effectively establishes a connection that maintains conductivity when de-coupled from a device, provides the ability to inject additional power onto the network, and includes separate power and signal conductors positioned to mitigate electrical noise.

BRIEF DESCRIPTION

The embodiments in the present disclosure describe a novel modular connector for power and data network systems. The connector comprises a lower body having at least one orientation key and a plurality of conductor severing mechanisms, where the lower body encloses a cavity containing a plurality of spring connectors where each spring connector corresponds and is electrically connected to two of an insulation displacement member of a plurality of insulation displacement members aligned in two rows along the top surface of the lower body. The connector also has an upper body also having at least one orientation key, each orientation key positioned to receive a corresponding set of keying voids in a multi-conductor ribbon cable. Each insulation displacement member is connected to one of a plurality of spring connectors arrayed in opposing pairs in the receiving cavity of the lower body. Each spring connector is electrically connected to one of a plurality of insulation displacement members, and each member of an opposing pair of spring connectors is in contact with the other and provides a conductive path when unmated. When mated to an interface circuit board, the conductive path is through traces on the interface board having configurable circuit completing devices which are used to determine the flow of signals to the connected device and other devices on the network.

DRAWINGS

These and other features, aspects, and advantages of the disclosed embodiments will become better understood when the following detailed description is read with reference to the accompanying drawings in which like characters represent like parts throughout the drawings, wherein:

FIG. 1 is a perspective drawing of an electromagnetic switching device with network interface;

FIG. 1*a* is a diagrammatical illustration of a device network including a number of nodes;

FIG. 2 is a perspective drawing of a connector with an associated ribbon cable placed on a header board which is on a network interface printed circuit board;

FIG. 3 is an exploded perspective view of a connector, ribbon cable, header board, and a network interface printed circuit board;

Figure 4A:
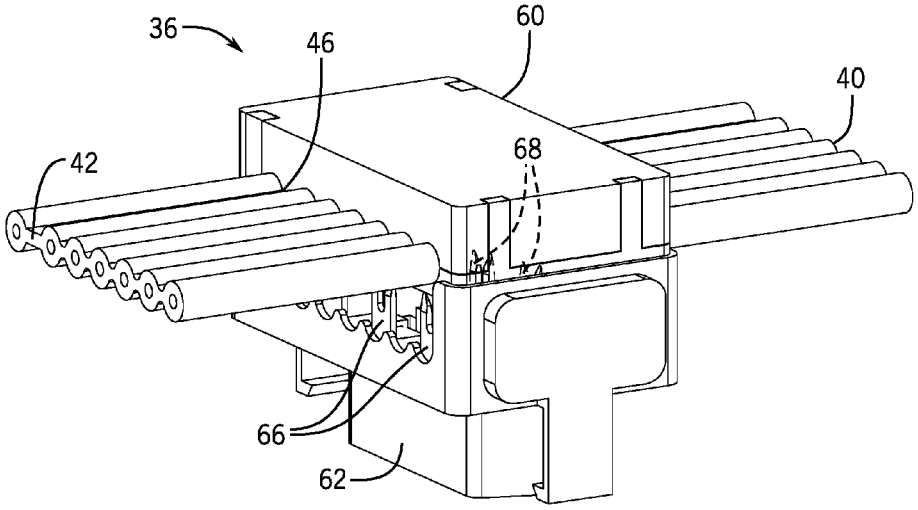
Figure 4B:
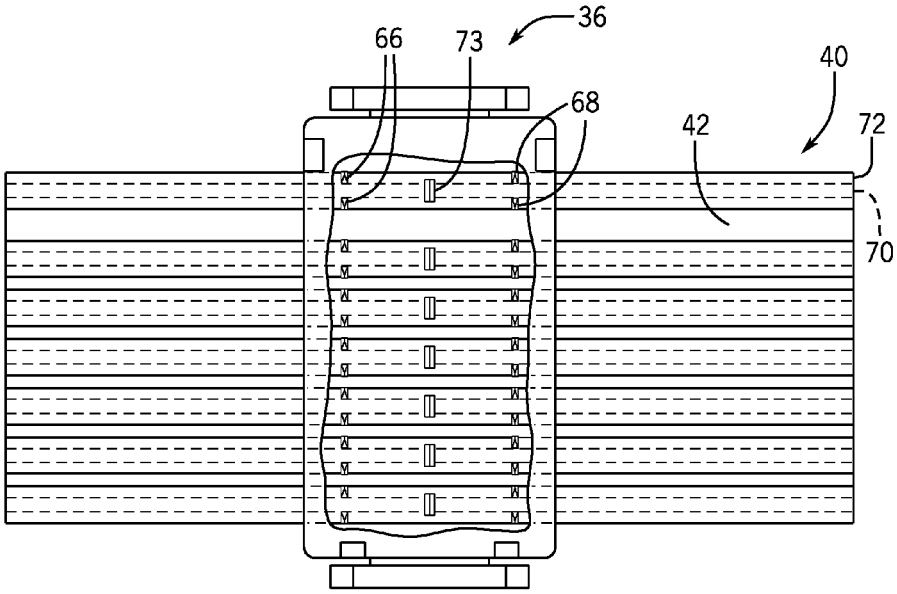
Figure 5B:
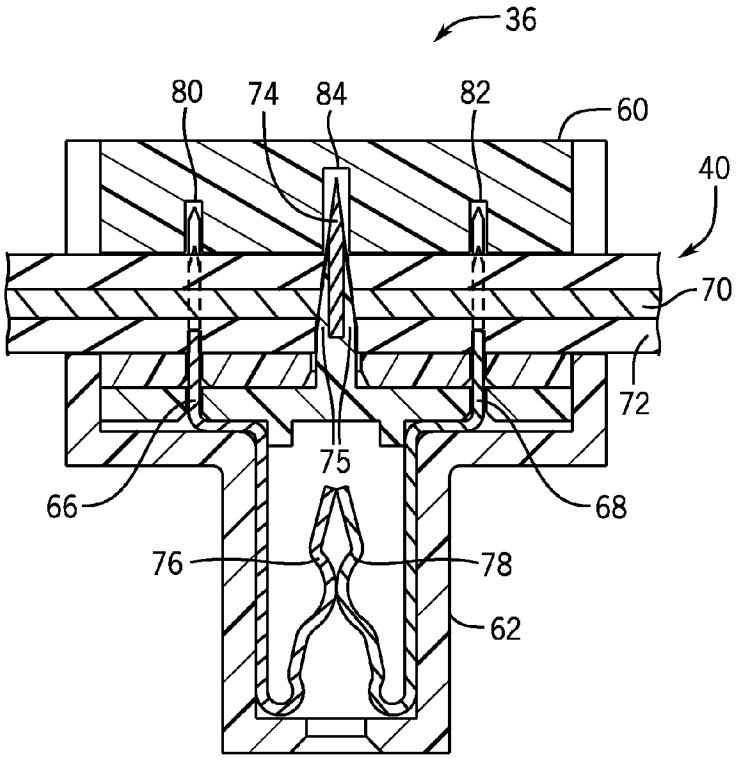
Figure 5A:
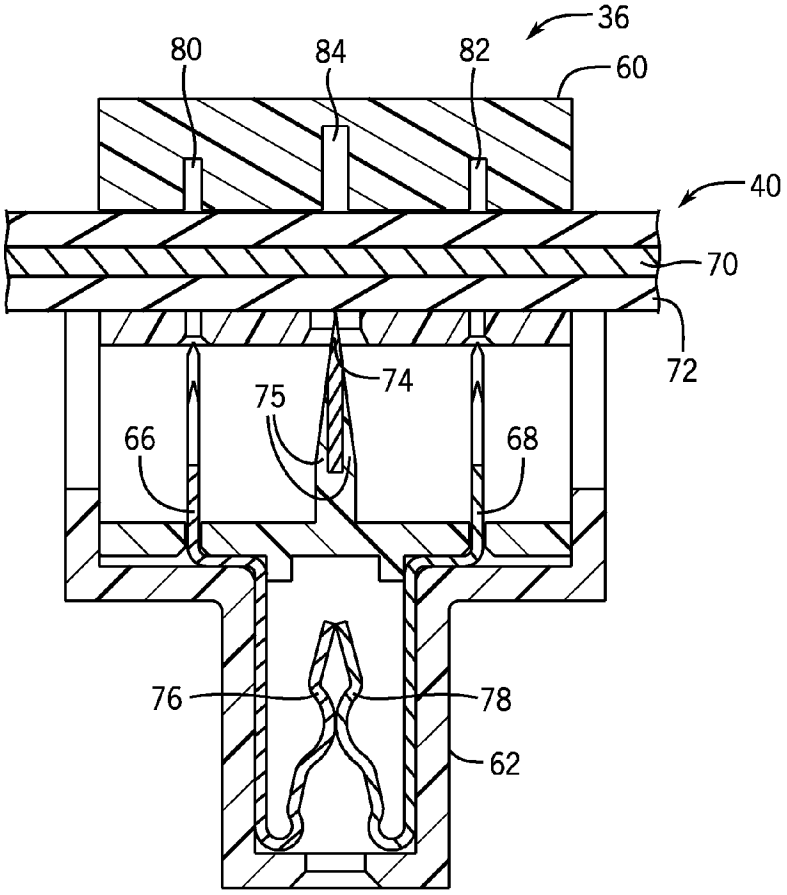
Figure 6B:
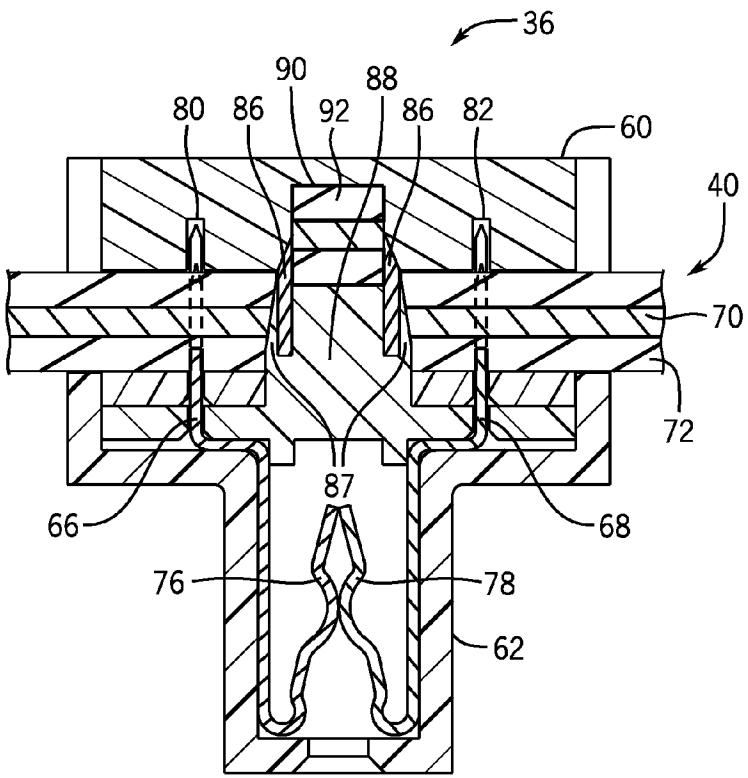
Figure 6A:
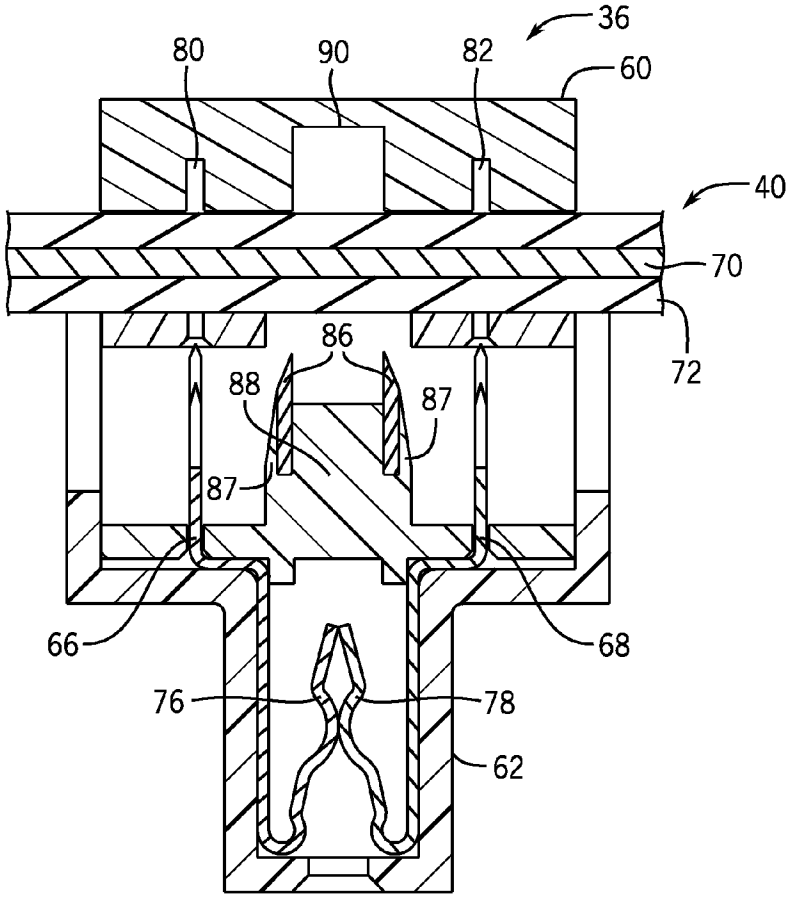
Figure 7:
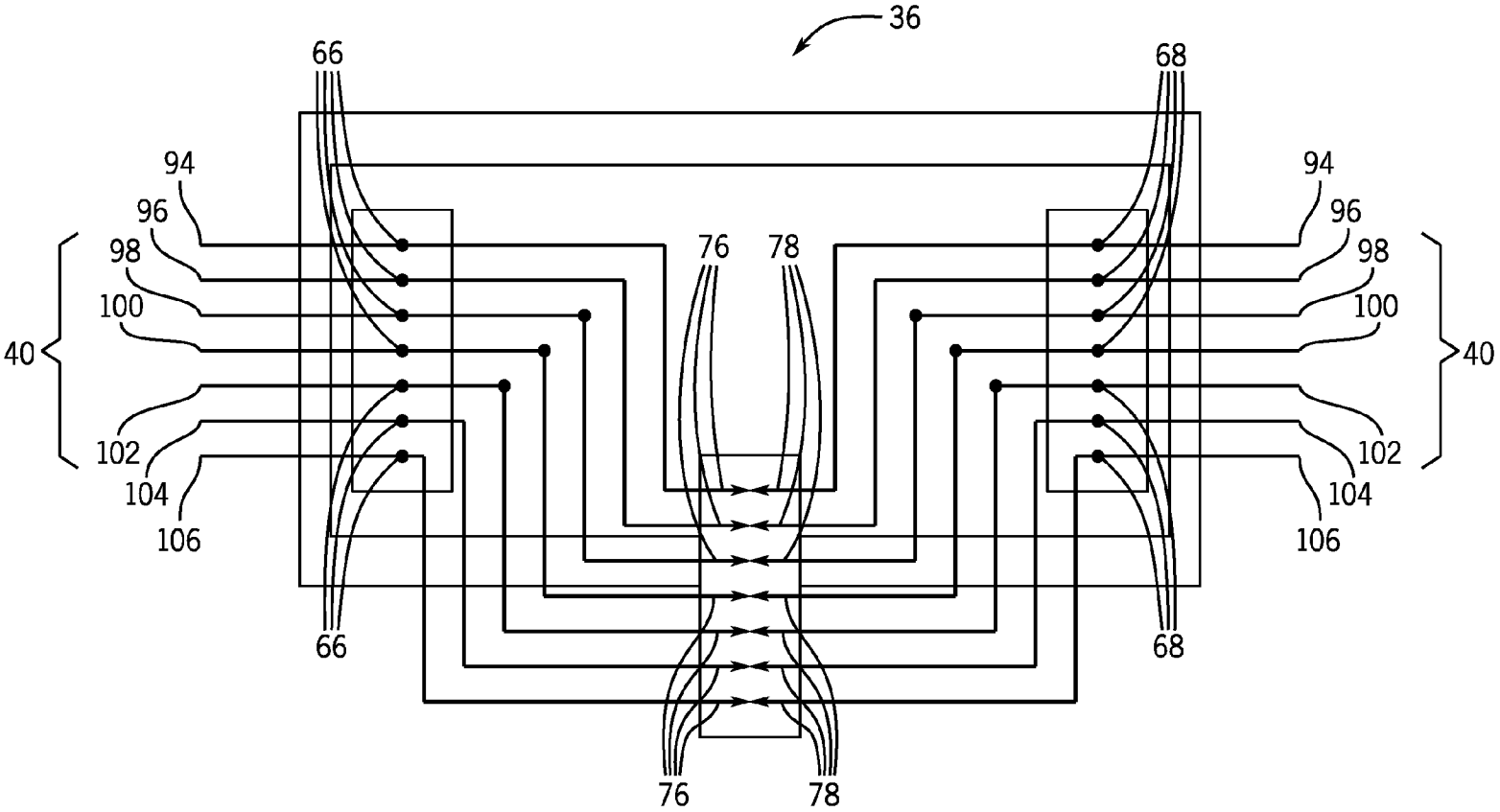
Figure 8:
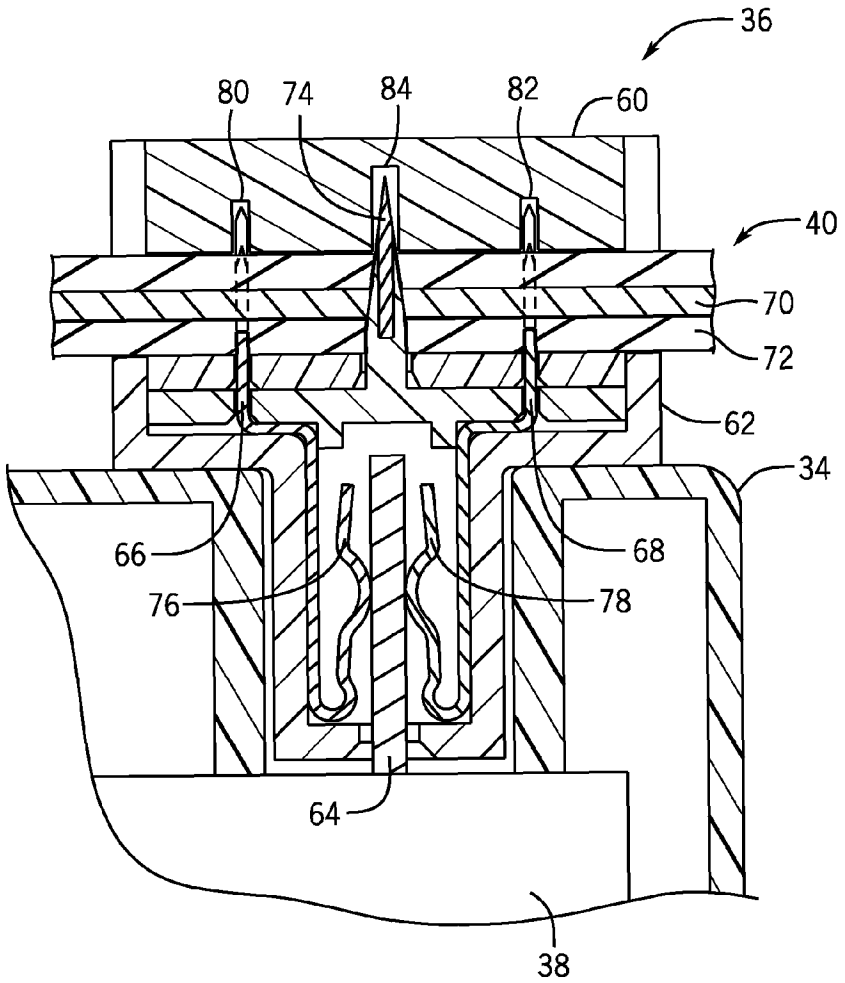
Figure 9:
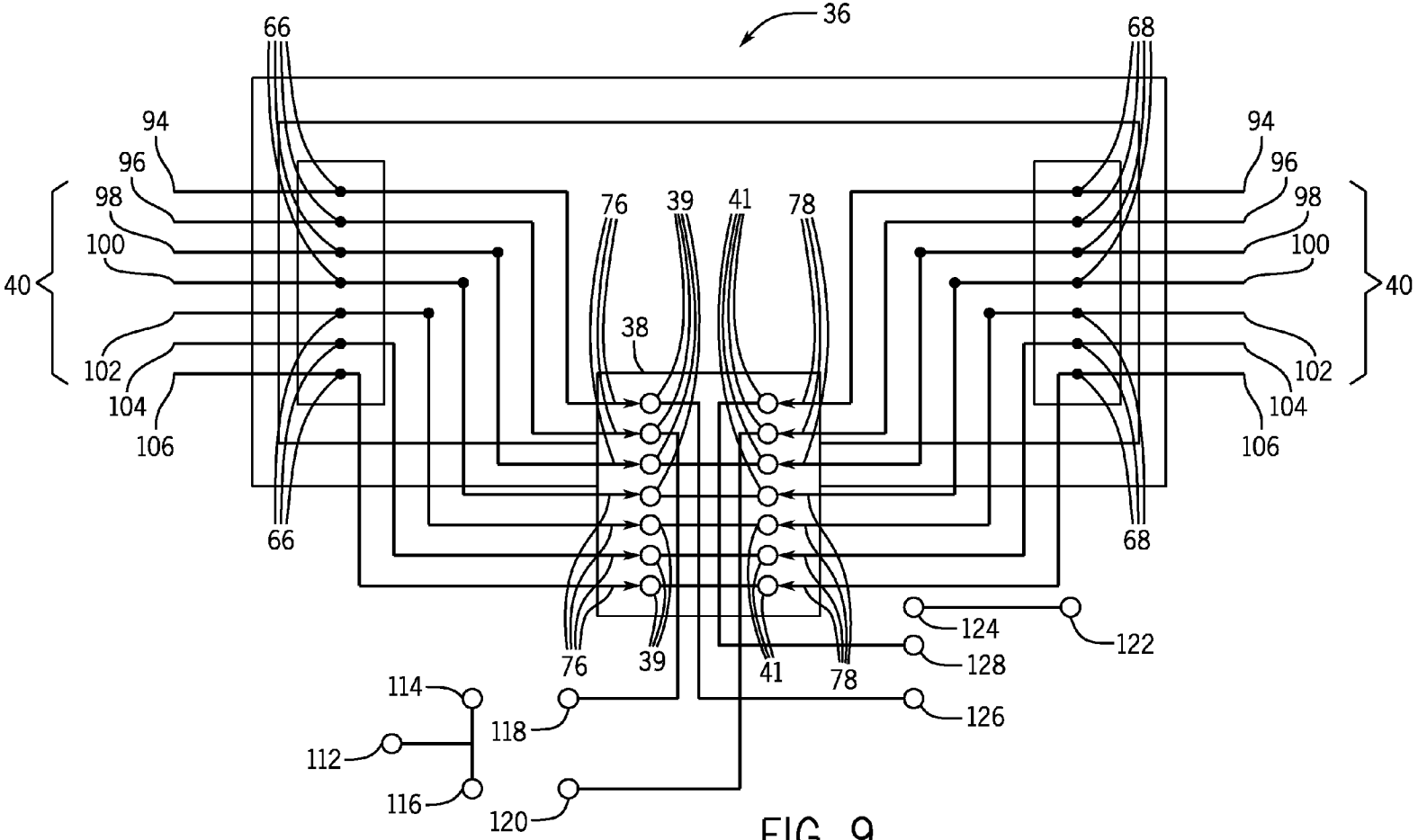
Figure 10:
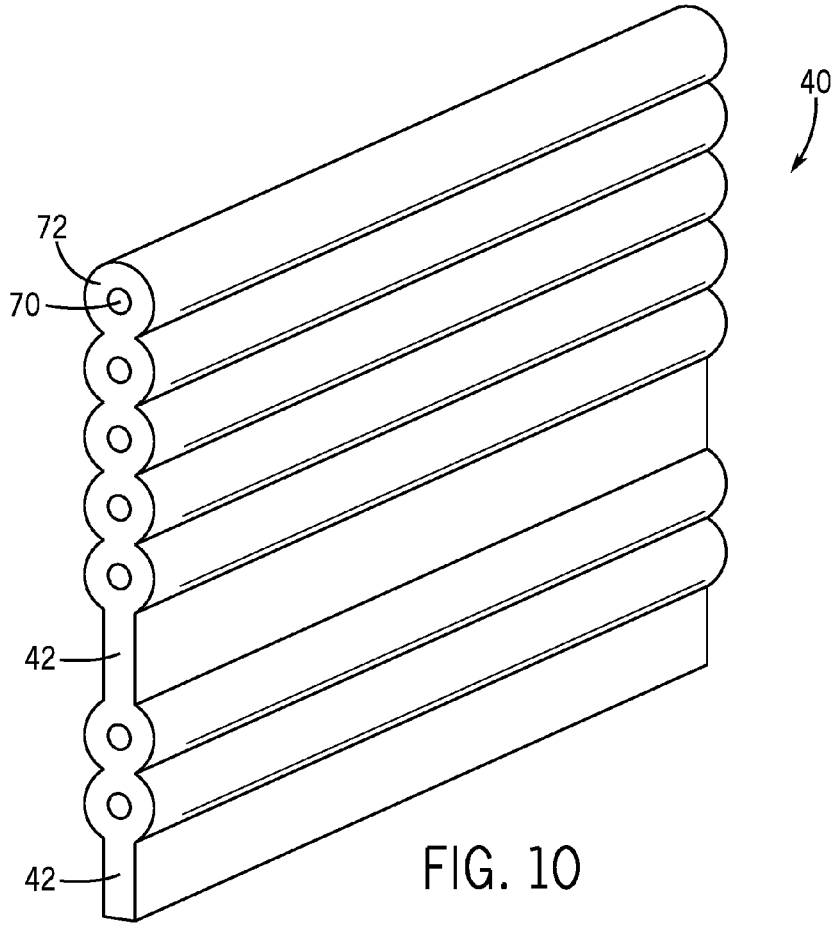
Figure 11:
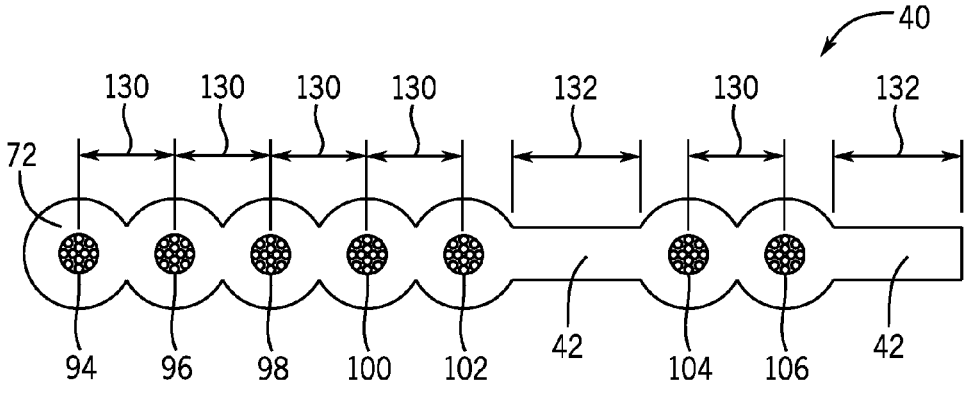
Figure 12:
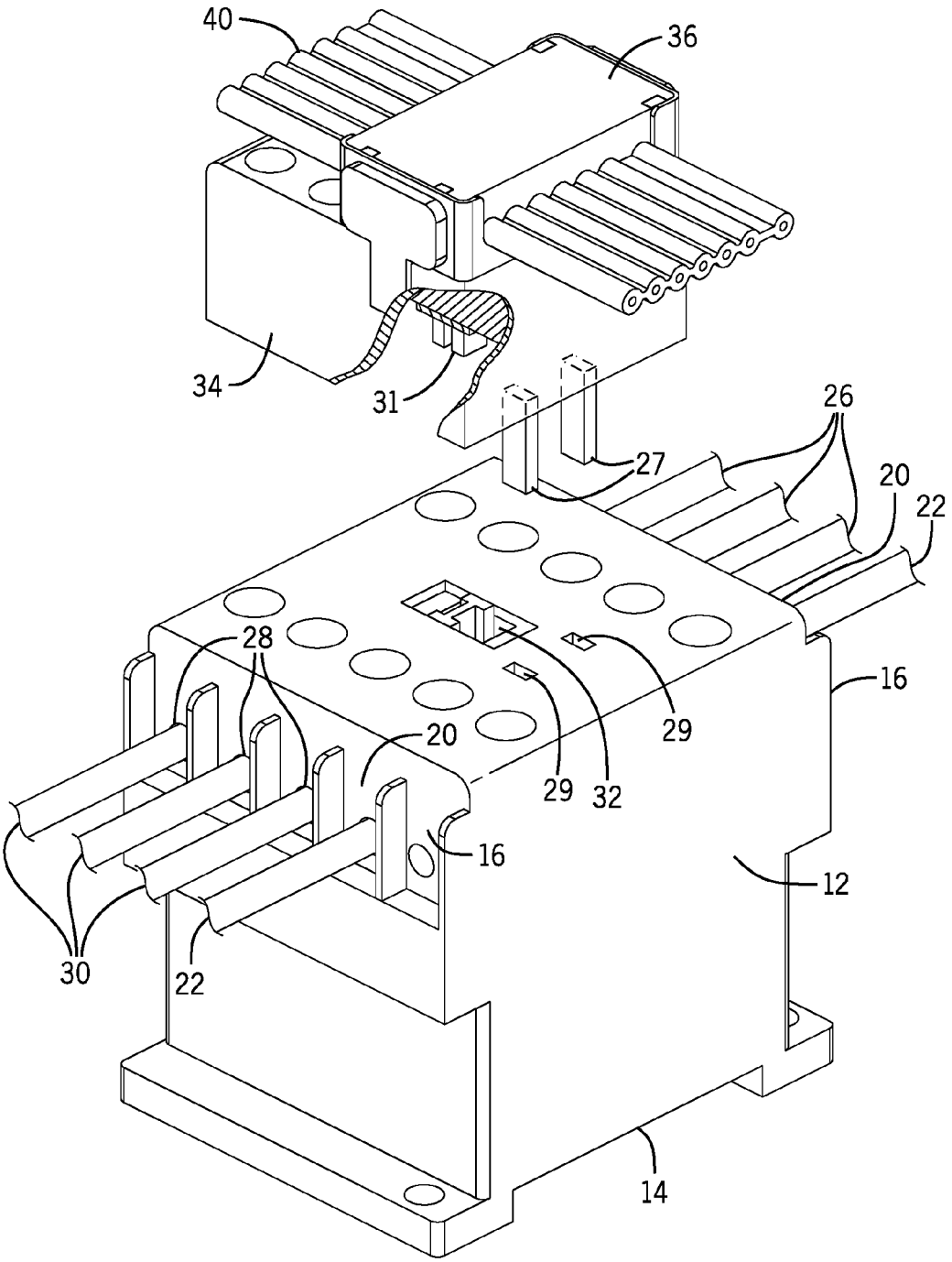

FIG. 3*a* is a detailed view of a header board and associated circuit traces;

FIG. 4*a* is a perspective view of an embodiment of a connector showing it in the pre-crimped state;

FIG. 4*b* is a perspective view of an embodiment of a connector showing it in the crimped state;

FIG. 5*a* is a cutaway end view of an embodiment of a connector using a wire cutter in the pre-crimped state;

FIG. 5*b* is a cutaway end view of an embodiment of a connector using a wire cutter in the crimped state;

FIG. 6*a* is a cutaway end view of an embodiment of a connector using a wire punch in the pre-crimped state;

FIG. 6*b* is a cutaway end view of an embodiment of a connector using a wire punch in the crimped state;

FIG. 7 is a schematic diagram of a connector in the un-plugged state;

FIG. 8 is a cutaway end view of a connector plugged on to a header and associated printed circuit board in a network interface;

FIG. 9 is a schematic diagram of a connector in the plugged state;

FIG. 10 is a perspective view of a multi-conductor ribbon cable with keying voids;

FIG. 11 is an end view of a multi-conductor ribbon cable with keying voids; and FIG. 12 is a perspective view of an alternate embodiment of an electromagnetic switching device with network interface.

DETAILED DESCRIPTION

Figure 1:
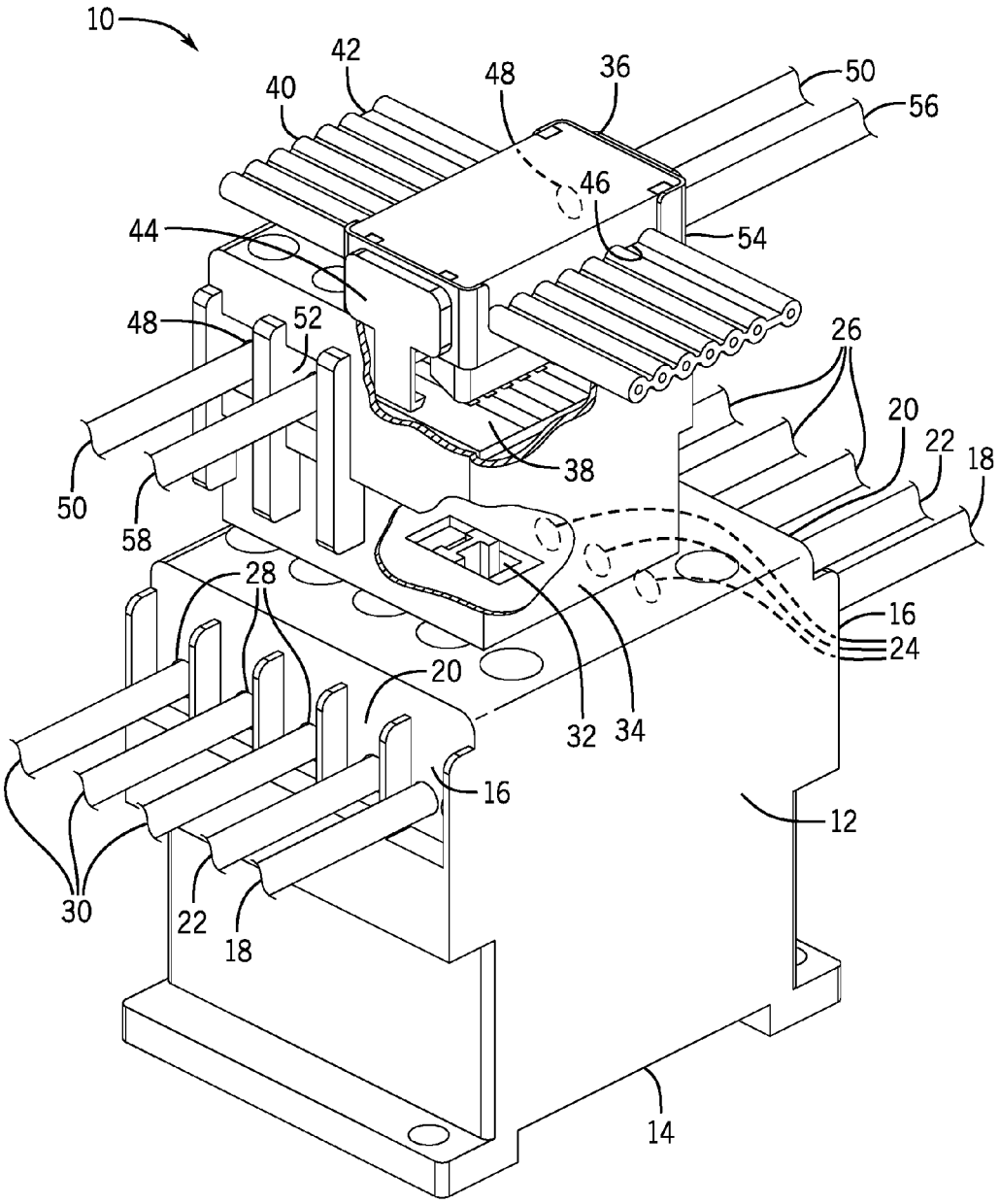

Turning now to the drawings, and referring to FIG. 1, a circuit interrupting device is illustrated in the form of an electromagnetic contactor with network interface 10 for controlling electrical current on multiple current carrying paths. The electromagnetic contactor with network interface 10 comprises an electromagnetic contactor 12 having a generally rectangular body providing a slot 14 therein for receiving a standard DIN rail along the transverse axis generally within the plane of the base. Electromagnetic contactor 12 has a number of electrically isolated contact sections each configured to receive electrical inputs via power input conductors 26 connected to power terminal blocks 24 and deliver electrical outputs to a load via load output conductors 30 connected to load terminal blocks 28 when the electromagnetic contactor 12 is placed in a state resulting in a completed electrical circuit. This state is controlled by passing an electric current through the electromagnetic coil contained within the device whose electrical connections are made accessible via the coil terminal blocks 16, the current being conveyed to the device via coil wires 18. Additionally, electromagnetic contactor 12 may include auxiliary contacts which are contained within the device, whose state changes in concert with that of the electromagnetic contactor 12. Electrical connections to these auxiliary contacts are made via auxiliary contact terminal blocks 20 with current conducted via auxiliary contact terminal wires 22. Other conceivable embodiments may include a direct electrical interface from network interface 34 to electromagnetic contactor 12 obviating the need for wiring between the devices for the coil. Such an embodiment is shown in FIG. 12. In this embodiment network interface 34 is electrically coupled to electromagnetic contactor 12 via network interface electrical mating connections 27 coupled to device electrical mating connections 29. Device electrical mating connections 29 are connected to the coil of electromagnetic contactor 12 and its actuation is controlled directly from network interface 34.

Continuing with FIG. 1, in addition to an electromagnetic contactor 12, electromagnetic contactor with network interface 10 includes a network interface 34. Network interface 34 is coupled to electromagnetic contactor 12 and is actuated in unison via a mechanical interface 32 such that when the state of electromagnetic contactor 12 changes that of network interface 34 changes as well. Connector 36 is attached to printed circuit board 38 contained within network interface 34. In this particular embodiment connector 36 is secured to network interface 34 via a pair of latches 44 placed on each side of the connector and mating with a slot on network interface 34. It is conceivable that for some applications alternate embodiments of securing the attachment may include captive screws in place of the latches. In this particular embodiment, connector 36 is attached to ribbon cable 40 which provides power and data transmission to network interface 34 and similarly to associated devices on the network. Ribbon cable 40 contains a void 42 in the cable which matches an orientation key 46 on connector 36 in order facilitate the correct orientation of connector 36 when connecting to ribbon cable 40. It is important to note that the number of voids, their width, and position in the cable may vary depending upon the application without diverging from the intent of the disclosed embodiments.

In the embodiment illustrated in FIG. 1, network interface 34 provides electrical current to positive output terminal 52 and negative output terminal 54 where electrical current is obtained from conductors on ribbon cable 40 and provided via positive output terminal wire 56 and negative output terminal wire 58 to corresponding coil wires 18. This allows network interface 34 to control the state of electromagnetic contactor 12 via network signals on ribbon cable 40. Additionally, network interface 34 may include an auxiliary contact whose electrical interface is provided via network interface auxiliary contact terminal blocks 48 and associated electrical connections via network interface auxiliary contact terminal wires 50.

Figure 1A:
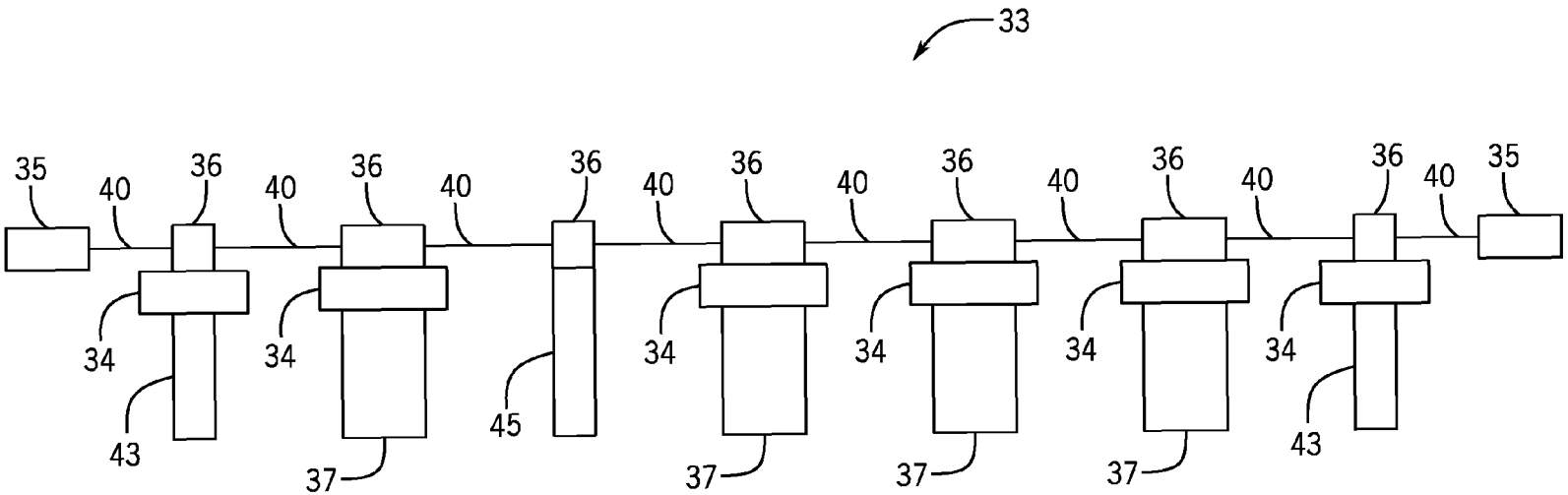

In FIG. 1*a* a data and power network is illustrated diagrammatically and designated generally by the reference numeral 33. The network includes a plurality of device nodes 37 coupled to one another via a network interface 34 and a network ribbon cable 40. One embodiment of a device node 37 is an electromagnetic contactor 12 and network interface 34 attached to ribbon cable 40 with connector 36 which is illustrated in FIG. 1 as electromagnetic contactor with network interface 10. Each device node 37 receives power and data signals from cable 40 via a modular connector 36 attached to network interface 34. At ends of cable 40 terminators 35 are provided for capping the cable ends and electrically terminating the signal conductors of the cable. Intelligent power taps 43 are connected to network 33 with connector 36 on network interface 34 via ribbon cable 40 for the purpose of providing electrical power to network 33 typically in the form of 24 volts DC. As illustrated, intelligent power taps 43 are intelligent devices having the ability to interact with the control and data signals of the network in addition to providing various forms of power. An alternate embodiment of a power tap could be a non-intelligent power tap 45. Non-intelligent power tap 45 only provides power to the network and thus connector 36 couples directly to non-intelligent power tap 45 with no need for network interface 34. Various embodiments of device node 37 may include devices such as push-button switches, motor starters, proximity sensors, flow sensors, speed sensors, actuating solenoids, electrical relays, electrical contactors, and so forth each adapted to receive an embodiment of network interface 34. As will be appreciated by those skilled in the art, each device node 37 may transmit and receive control and data signals via ribbon cable 40 in accordance with various standard protocols in addition to receiving various forms of electrical power.

Considering FIG. 2, FIG. 3, and FIGS. 4*a* and 4*b* as a group the relationship of connector 36 and the parts that it is comprised of in relation to ribbon cable 40 are illustrated. Beginning with FIG. 2, a perspective view of connector 36 and ribbon cable 40 attached to interface circuit board 38 via header board 64 is illustrated. Interface circuit board 38 includes a number of right interface circuit board traces 39 and left interface circuit board traces 41 that are electrically connected to right header circuit board traces 63 and left header circuit board traces 65 on header circuit board 64 as illustrated in FIG. 3.

An exploded perspective view is illustrated in FIG. 3. Connector 36 is comprised of an upper portion 60 and a lower portion 62. The ribbon cable 40 is located transversely between upper portion 60 and lower portion 62 such that when upper portion 60 and lower portion 62 are compressed together by a crimping tool a connection to each conductor contained within ribbon cable 40 is made via the insulation displacement members 66 which are typically configured such that there are two connections per conductor in the ribbon cable, one on the left and one on the right as illustrated in FIG. 4*b*. Additionally, each conductor 70 in ribbon cable 40 is severed by a severing device 73 such that once connector 36 is attached to ribbon cable 40 electrical current no longer flows directly through each conductor 70 but through a path in connector 36 which will be explained further on in this specification. As illustrated in FIG. 2, FIG. 3, and FIGS. 4*a* and 4*b*, upper portion 60 and lower portion 62 of connector 36 have an orientation key 46 which aligns with cable void 42 of ribbon cable 40 in order to facilitate the correct orientation of connector 36 on ribbon cable 40. FIG. 4*b* provides a cutaway view of the top of connector 36 once it is crimped in position on ribbon cable 40. The insulation 72 of each conductor 70 in ribbon cable 40 is displaced by an insulation displacement member 66 on both the left and right sides of connector 36 and the center of each conductor 70 is severed by a severing device 73. It is easily conceivable by one skilled in the art that the number of power and network signal conductors in ribbon cable 40 and associated connector 36 may vary from that illustrated in the present embodiment. Additionally, the number of orientation keys 46 in connector 36 and voids 42 in ribbon cable 40 and their position may vary as needed depending upon the application.

Turning to FIGS. 5*a* and 5*b* an end view of an embodiment of connector 36 is shown. In this embodiment the cable severing device is a blade 74 held in position by an insulated holder 75. Each conductor 70 in ribbon cable 40 has an associated blade 74 positioned below it in connector lower portion 62. When connector upper portion 60 is crimped to ribbon cable 40 with connector lower portion 62 each conductor 70 in ribbon cable 40 is severed. Upon the completion of the crimp the blade 74 comes to rest in blade displacement void 84 and each conductor 70 is severed and insulated from directly conducting by insulated holder 75. In addition, as previously described, the insulation 72 of each conductor 70 in ribbon cable 40 is displaced by a left insulation displacement member 66 and a right insulation displacement member 68. The insulation displacement members 66 and 68 come to rest in their corresponding voids 80 and 82 in connector upper portion 60 at the end the crimping event as illustrated in FIG. 5*b*. Once connector upper portion 60 is crimped to ribbon cable 40 with connector lower portion 62 and each conductor 70 is severed by its corresponding blade 74 and connected to its corresponding insulation displacement member 66 and 68 the only electrically conductive path for each conductor 70 is through that provided by each corresponding left spring connector 76 and right spring connector 78.

An alternate embodiment is illustrated in FIGS. 6*a* and 6*b*. Depicted is a cutaway end view of connector 36. In this embodiment a wire punch 86 held in position by an insulated holder 87 correspond to each conductor 70 in ribbon cable 40. In a similar fashion as previously described, each conductor 70 in ribbon cable 40 has an associated punch 86 positioned below it in connector lower portion 62. When connector upper portion 60 is crimped to ribbon cable 40 with connector lower portion 62 each conductor 70 in ribbon cable 40 is severed. Upon the completion of the crimp the punch 86 in addition to the severed portion 92 of each conductor 70 comes to rest in punch displacement void 90 and each conductor 70 is severed and insulated from directly conducting by insulated holder 87. In addition, the insulation 72 of each conductor 70 in ribbon cable 40 is displaced by a left insulation displacement member 66 and a right insulation member 68. The insulation displacement members 66 and 68 come to rest in their corresponding voids 80 and 82 in connector upper portion 60 at the end the crimping event as illustrated in FIG. 6*b*. Once connector upper portion 60 is crimped to ribbon cable 40 with connector lower portion 62 and each conductor 70 is severed by its corresponding punch 86 and connected to its corresponding insulation displacement member 66 and 68 the only electrically conductive path for each conductor 70 is through that provided by each corresponding left spring connector 76 and right spring connector 78.

A schematic representation of an embodiment of an un-plugged connector 36 is illustrated in FIG. 7. As shown in FIG. 4*b*, the insulation 72 of each conductor 70 in ribbon cable 40 is displaced by a left insulation displacement member 66 and a right insulation member 68 which is further illustrated in FIG. 7. In this embodiment the number of conductors 70 in ribbon cable 40 is seven for the exemplary network embodiment but as previously described it is conceivable that the number of power and network signal conductors could vary for any given application without altering the intent of the disclosed embodiments. It is important to note that each left spring connector 76 and each corresponding right spring connector 78 are in contact and providing electrical conductivity for the signal in each conductor 70 in ribbon cable 40 in this state. In this particular embodiment the electrical signals passing through connector 36 may be assigned as shown in the following table, table 1:

| Conductor element number | Electrical Signal |
|---|---|
| 94 | Switched Power Positive 140 |
| 96 | Network Power Positive 136 |
| 98 | Network Signal Positive 144 |
| 100 | Network Signal Negative 146 |
| 102 | Network Power Negative 138 |
| 104 | Switched Power Negative 142 |
| 106 | Discovery 134 |

An alternate embodiment of the electrical signals passing through connector 36 may be assigned as shown in the following table, table 2:

| Conductor element number | Electrical Signal |
|---|---|
| 94 | Discovery 134 |
| 96 | Network Power Positive 136 |
| 98 | Network Signal Positive 144 |
| 100 | Network Signal Negative 146 |
| 102 | Network Power Negative 138 |
| 104 | Switched Power Negative 142 |
| 106 | Switched Power Positive 140 |

Another alternate embodiment of the electrical signals passing through connector 36 may be assigned as shown in the following table, table 3:

| Conductor element number | Electrical Signal |
|---|---|
| 94 | Network Power Positive 136 |
| 96 | Network Signal Positive 144 |
| 98 | Network Signal Negative 146 |
| 100 | Network Power Negative 138 |
| 102 | Discovery 134 |
| 104 | Switched Power Negative 142 |
| 106 | Switched Power Positive 140 |

As indicated in the preceding tables ribbon cable 40 typically comprises pairs of signal conductors and pairs of power conductors with some individual conductors as well. For example, Network Signal Positive 144 and Network Signal Negative 146 comprise a signal conductor pair and Network Power Positive 136 and Network Power Negative 138, and Switched Power Positive 140 and Switched Power Negative 142 comprise a power conductor pair.

It is important to note that as indicated in FIG. 7 when connector 36 is in the un-plugged state the conductivity path for each conductor 70 of ribbon cable 40 is complete and electrical current and signals continue to flow via each left spring connector 76 and each corresponding right spring connector 78. It is conceivable that the number, types, and ordering of electrical power and signals carried by conductors 70 in ribbon cable 40 could vary widely for a given application without diverging from the intent of the disclosed embodiments. For instance, the choice of assigning signals to particular conductors 70 in ribbon cable 40 may be done so as to increase noise immunity, minimizing electromagnetic interference (EMI) between the conductors and the signals that they carry. Conceivable embodiments include separating power signals from network signals using one or more keying voids 42 between corresponding conductors or placing switched power conductors in distal relation to other conductors.

Referring to FIG. 8, a cutaway end view of an embodiment of connector 36, in this instance that of FIGS. 5*a* and 5*b* is shown coupled to header board 64 on interface circuit board 38 in network interface 34 which is in turn mechanically coupled to electromagnetic contactor 12 as illustrated in FIG. 1. When connector 36 is placed in this position, header board 64 separates each corresponding left spring connector 76 and right spring connector 78 thus breaking the electrical conductivity of each conductor 70 in ribbon cable 40 via the direct connection of each corresponding left spring connector 76 and right spring connector 78. Header board 64 is electrically connected to interface board 38 via left header circuit board trace 65 which correspond to left interface circuit board trace 39 and right header circuit board traces 63 that correspond to right interface circuit board trace 41 as illustrated in FIG. 3. It is conceivable that header board 64 may be integrated directly into interface circuit board 38 such that they are co-planar as required in applications for devices requiring a different packaging than that illustrated in the current embodiment without deviating from the intent of the disclosed embodiments.

Recalling from FIG. 1*a*, as previously described nodes on network 33 typically comprise device nodes 37 and intelligent power taps 43 connected to ribbon cable 40 with connector 36 which is in turn placed upon header board 64 which is electrically connected to interface board 38. Turning to FIG. 9, a schematic representation of an embodiment of a connector 36 plugged on to intelligent power tap 43 is illustrated. As previously discussed, the insulation 72 of each conductor 70 in ribbon cable 40 is displaced by a left insulation displacement member 66 and a right insulation displacement member 68 as illustrated mechanically in FIG. 4*b* and electrically in FIG. 9. Furthermore, when connector 36 is plugged on to header board 64, each left spring connector 76 comes into contact with each corresponding left header circuit board trace 65 which is connected to corresponding left interface circuit board trace 39 and each right spring connector 78 comes into contact with corresponding right header circuit board trace 63 which is connected to corresponding right interface circuit board trace 41.

Continuing with FIG. 9, in each embodiment it is desirable to allow some of the electrical signals contained on each conductor 70 of ribbon cable 40 to pass unaltered through the combination of connector 36, header board 64, and interface circuit board 38 and other signals may be altered or suspended. Considering the embodiment of signal assignments contained in table 1, signals Network Signal positive 144 on conductor 98, Network Signal negative 146 on conductor 100, Network Power negative 138 on conductor 102, Switched Power negative 142 on conductor 104 are passed through the combination of connector 36 and header board 64 unaltered. In certain embodiments this may be accomplished through the use of a via 69 on header board 64 as illustrated in FIG. 3*a* and in other embodiments by circuit board traces on interface circuit board 38. If the node on network 33 is an intelligent power tap 43 it may be desirable to suspend or alter Switched Power positive 140 and\or Network Power positive 136. In the case of Network Power positive 136 on conductor 96, as illustrated in FIG. 9, a source of electricity matching the electrical characteristics of Network Power positive 136 is provided at connection point 112 on interface circuit board 38. In the event that it is desired to suspend Network Power positive 136 on conductor 96 no electrical connection is made between connection point 118 and connection point 120 on interface circuit board 38. If it is desired to provide additional Network Power positive 136 on conductor 96 to the left portions of the network an electrical connection is made between connection point 114 and connection point 118 on interface circuit board 38. If it is desired to provide additional Network Power positive 136 on conductor 96 to the right portions of the network an electrical connection is made between connection point 116 and connection point 120 on interface circuit board 38. If it is desired to simply pass Network Power positive 136 on conductor 96 through connector 36 an electrical connection is made between connection point 118 and connection point 120. Similarly, in the case of Switched Power positive 140 on conductor 94, a source of electricity matching the electrical characteristics of Switched Power positive 140 on conductor 94 is provided at connection point 122 on interface circuit board 38. If it is desired to suspend Switched Power positive 140 on conductor 94 no electrical connection is made between connection point 126 and connection point 128 on interface board 38. If it is desired to pass Switched Power positive 140 on conductor 94 through connector 36 an electrical connection is made between connection point 126 and connection point 128. And finally if it is desired to provide additional Switched Power positive 140 on conductor 94 to the right portions of the network an electrical connection is made between connection point 124 and connection point 128 on interface circuit board 38. The electrical connections between connection points 114, 116, 118, 120, 124, 126, and 128 may be established by any number of means including but not limited to jumpers on pin headers, Dual In-Line Package (DIP) switches, relays, or semiconductor switching devices. Additionally, it is conceivable that configuration information may be written to network interface 34 via network 33 through the use of a computer running a configuration software program. Any number of combinations of signals being passed through, altered, enhanced, or suspended is conceivable for any device on network 33 whether that is a device node 37 or an intelligent power tap 43. Generally stated the method of signal selection would include the following steps of determining the number and type of devices 37 required for an application, calculating the network power requirements, calculating the switched power requirements, selecting the number of intelligent power taps 43 and non-intelligent power taps 45 required to meet network and switched power requirements, determining the distribution of intelligent power taps 43 and non-intelligent power taps 45 on network 33, positioning a plurality of devices 37, intelligent power taps 43, and non-intelligent power taps 45 on network 33, setting configurable circuit completing devices in a plurality of network interface 34, mechanically coupling a network interface 34 to a plurality of devices 37 and intelligent power taps 43, mechanically coupling a connector 36 to each of a plurality of network interface 34 on devices 37 and intelligent power taps 43, and non-intelligent power taps 45. The described embodiment is just one of a number of possible embodiments that could be conceived by a person skilled in the art.

Finally, FIG. 10 illustrates ribbon cable 40 with additional detail provided in FIG. 11. As previously described, ribbon cable 40 includes network signal conductors and power conductors disposed generally parallel to one another in a common plane. In reference to the signal assignments in table 2 above, FIG. 11 illustrates Discovery 134 on conductor 94, Network Power Positive 136 on conductor 96, Network Signal Positive 144 on conductor 98, Network Signal Negative 146 on conductor 100, Network Power Negative 138 on conductor 102, Switched Power Negative 142 on conductor 104, and Switched Power Positive 140 on conductor 106. Discovery 134, Network Signal Positive 144, and Network Signal Negative 146 are network signal conductors. Network Power Positive 136, Network Power Negative 138, Switched Power Positive 140, and Switched Power Negative 142 are power signals. The preferred structure of ribbon cable 40 and the advantages flowing from the preferred structure include an insulative cover or jacket 72 encapsulating the signal and power conductors, insulator 72 narrows to form a reduced thickness physical key or void 42 which corresponds to the placement of orientation key 46 on connector 36, thereby ensuring that each network connector 36 is properly and uniformly positioned with respect to the conductors carried within ribbon cable 40 during installation. The number, width 132, and position of physical key or void 42 on ribbon cable 40 could vary without deviating from the intent of the disclosed embodiments. Additionally, as previously described, within ribbon cable 40, conductors 94-106 and the network signals or power that they conduct in any given embodiment may be assigned or ordered in such a way so as to minimize electromagnetic interference (EMI.) It could also be conceived by a person skilled in the art to vary the spacing 130 between conductors 94-106 so as to provide further immunity to noise especially between signal conductors and power conductors.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosed embodiments.

The invention claimed is:

1. A connector for a power and data transmission network cable for use with a network, the network including a plurality of devices configured to be coupled to one another via the cable, the connector comprising:

a lower body having at least one orientation key and a plurality of conductor severing mechanisms, the lower body enclosing a cavity containing a plurality of spring connectors, each spring connector corresponding and electrically connected to two of an insulation displacement member of a plurality of insulation displacement members forming first and second rows;

an upper body having at least one orientation key in spaced apart relation to the lower body in a first position and a second position adapted for engaging a multi-conductor cable between the upper body and lower body; and wherein the multi-conductor ribbon cable is adapted to receive at least one orientation key on opposing sides, wherein the insulating jacket of the multi-conductor ribbon cable has a first thickness surrounding conductors, a second thickness between adjacent conductors, and a third thickness for receiving orientation keys, and wherein the orientation keys define a space configured to receive the multi-conductor ribbon cable in corresponding keyed orientation.

2. The connector of claim 1, wherein each conductor of the multi-conductor is severed and brought into electrical contact with conductor engaging portions of two opposing insulation displacement members.

3. The connector of claim 1, wherein the insulating jacket of the multi-conductor ribbon cable is sufficiently resilient to permit piercing by insulation displacement members for coupling conductors to spring connectors.

4. The connector of claim 1, wherein the conductors of the multi-conductor cable are disposed parallel to one another in a common plane with signal conductors at a first distance and power conductors at a second distance.

5. The connector of claim 1, wherein the conductors of the multi-conductor cable are disposed parallel to one another in a common plane ordered such that power conductors do not electrically couple with signal conductors.

6. The connector of claim 1, wherein the severing mechanism is a blade corresponding to each conductor.

7. The connector of claim 1, wherein the severing mechanism is a punch corresponding to each conductor.

8. The connector of claim 1, wherein the connector is configured to receive an edge connector on a printed circuit board.

9. A connector for a power and data transmission network cable, a network including a plurality of nodes configured to be coupled to one another via the cable, the connector comprising:

An upper body and a lower body each having at least one orientation key adapted to receive a multi-conductor ribbon cable, the lower body having a receiving cavity;

a multi-conductor ribbon cable adapted to receive orientation keys transversely positioned between the upper body and the lower body whose conductors are electrically coupled to insulation displacement members on lower body;

a plurality of spring connectors arrayed in opposing pairs in the receiving cavity each electrically connected to one of a plurality of insulation displacement members; each member of an opposing pair of spring connectors in contact with the other and providing a conductive path in a first position and a second position in which each member of an opposing pair of spring connectors is not in contact with the other and does not provide a conductive path.

10. The connector of claim 9, wherein the connector is configured to receive an edge connector on a printed circuit board.

11. The connector of claim 9, wherein the printed circuit board contains configurable circuit completing devices for selecting conductivity paths.

12. The connector of claim 11, wherein conductivity paths may be bypassed.

13. The connector of claim 11, wherein conductivity paths may be passed un-altered.

14. The connector of claim 11, wherein conductivity paths may have additional electrical power injected.

15. The connector of claim 11, wherein the configurable circuit completing devices are selected from the group consisting of header pin jumpers; dual in-line package switches, electromagnetic relays, and semiconductor switching devices.

16. An industrial control network connector system comprising:

an upper body and a lower body each having at least one orientation key adapted to receive a multi-conductor ribbon cable, the lower body having a receiving cavity adapted to receive an interface circuit board;

a plurality of spring connectors arrayed in opposing pairs in the receiving cavity each electrically connected to one of a plurality of insulation displacement members;

a multi-conductor ribbon cable adapted to receive orientation keys transversely positioned between the upper body and the lower body whose conductors are electrically coupled to insulation displacement members on lower body when upper body and lower body are operatively engaged;

air interface circuit board having conductive traces on opposing sides in corresponding relation to spring connectors wherein upon coupling with lower body opposing spring connectors are placed in contact with configurable circuit completing devices via conductive traces;

a network interface coupled to an industrial control device having a surface to receive the network device in operative engagement.

17. The connector system of claim 16, wherein the industrial control device is selected from the group consisting of push-button switches, motor starters; proximity sensors, flow sensors, speed sensors, actuating solenoids, electrical relays, and electrical contactors.

18. The connector system of claim 16, wherein network interface and industrial control device are mechanically coupled for operative engagement.

19. The connector system of claim 16, wherein the network interface controls the state of the industrial control device by network signals.

20. The connector system of claim 16, wherein the network interface obtains network power from the ribbon cable.

21. The connector system of claim 16, wherein the network interface obtains system power from ribbon cable.

* * * * *